United States Patent [19]

Guzman Guillen

[11] 4,140,296

[45] Feb. 20, 1979

[54] BOOK HOLDER

[76] Inventor: Federico Guzman Guillen, Edificio=Biarritz, 2nd piso #5, Caracas, Venezuela

[21] Appl. No.: 797,639

[22] Filed: May 17, 1977

[51] Int. Cl.[2] ..... A47B 97/04

[52] U.S. Cl. ..... 248/445; 248/286; 248/441 B

[58] Field of Search ..... 248/285, 286, 441 B, 248/441 C, 445; 403/61, 97; 240/2 P, 2 R

[56] References Cited

U.S. PATENT DOCUMENTS

| | | | |
|---|---|---|---|
| 194,116 | 8/1877 | Whitbeck | 403/61 |
| 308,335 | 11/1884 | Haegg | 403/97 X |
| 368,677 | 8/1887 | Maxwell | 248/441 C X |
| 1,037,140 | 8/1912 | French | 248/441 C X |
| 2,235,367 | 3/1941 | Heausler | 248/445 |
| 3,875,610 | 4/1975 | Wubbe | 403/97 X |

FOREIGN PATENT DOCUMENTS

| | | | |
|---|---|---|---|
| 1023440 | 3/1953 | France | 248/445 |

*Primary Examiner*—William H. Schultz
*Attorney, Agent, or Firm*—Toren, McGeady and Stanger

[57] ABSTRACT

A book holder includes a mounting bracket having a plate member so that the book holder can be mounted on a flat supporting surface such as a wall or a bedframe. The book holder has a first lever arm pivotally connected to the mounting bracket and a second lever arm connected to the first lever arm for articulated movement with respect to the first arm. The first and second lever arms each have a guide slot and a lockable connector assembly is carried for sliding movement in the guide slot of each of the lever arms for interconnecting the first and second lever arms. A book support is connected to an end of the second lever arm for supporting reading material. The book holder includes bookframes mounted on a rod for movement toward and away from each other to support therebetween the reading material. The bookframes have platforms with legs extending at 120° to each other so that a book may be supported therein with the pages at an angle of 120° to one another.

12 Claims, 6 Drawing Figures

BOOK HOLDER

BACKGROUND OF THE INVENTION

The present invention relates generally to the field of supporting racks for reading material or book holders, and more particularly to such a supporting rack or book holder which may be mounted directly onto or near a bed so that a person reclining in the bed may comfortably read material supported in the rack or holder.

A wide variety of book holders, supporting racks, bookstands, and other similar reading material retaining devices are, of course, well known in the art. Additionally, many such prior art devices have been proposed for attachment to beds so that persons in a reclining position would be able to comfortably view and read the material supported by such devices. Such known prior art devices, however, suffer from a number of disadvantages believed to be overcome by the teachings of the present invention.

For example, U.S. Pat. No. 3,889,914 discloses a book support rack which may be mounted at one end directly on a bedframe, carrying at the other end an appropriate rack for the reading material to be supported for viewing by a person reclining in the bed. The device shown in this prior patent requires the use of a particularly designed supporting base having a screw clamp so that the base may be mounted to a bedframe. Accordingly, this device can only be used with bedframes having the required shape and configuration upon which the clamp could be attached. No provision is made for attaching the device to a wall or other supporting structure adjacent the bed. The book rack disclosed in this patent includes a pair of arms connected to each other and to the base by elbow joints, the support rack being connected to one of the arms by a universal joint. Accordingly, continued use of the device requiring periodic repositioning and movement of the arms with respect to each other over a prolonged period of time will likely result in undesirable wear in the joints and ultimate failure. Because of the elbow and universal joint construction, movement of only one of the supporting arms will consequently necessitate movement of either the other supporting arm or the supporting rack in order to maintain the same angle of inclination of the reading material carried on the rack. Unnecessary use of the various joints will therefore result.

The known prior supporting devices also have other limitations with respect to the thickness of the book or reading material that can be supported in the holder. Further, the typical known book racks have supporting structure which requires that a book be held fully open with opposing leaves positioned at approximately 180° to each other. In other words, the pages of a book are maintained in a "flat" position which may result in undersirable damage to the bookbinding and also resulting in a difficult position for viewing all the printed words on the page.

Additionally, prior book holding devices have used a variety of spring mounted arms, spring clips, or other similar retaining devices for holding the pages in a fully open position for reading. This type of spring or clip arrangement frequently interferes with viewing a full page and causes difficulties in turning pages.

Other prior art devices, such as known from U.S. Pat. Nos. 1,692,237 and 2,359,895 require relatively complicated supporting structures rendering usage of the device difficult for reading and readjustment purposes. As with other prior devices, the devices of these patents require that the book holder or supporting rack be mounted directly on the bed. Any movement of the person reclining in the bed or movement of the bed from any external forces will result in movement of the supporting frame and movement of the book holder thus interrupting the viewer's concentration.

Accordingly, it is a general object of the present invention to provide a book holder for supporting a book or other reading material in a position for viewing by a person reclining in a bed which overcomes the various disadvantages of the prior art.

A more specific object of the present invention is to provide such a book holder which may be mounted either on a headboard or directly on a supporting wall independent of the headboard so that any movement in the bed will not be transmitted to the book holder.

Another object of the present invention is to provide a book holder of the foregoing type which is constructed of supporting arm levers pivotally connected with each other by a connector assembly thus avoiding the use of elbow or universal joints which may wear out over extended periods of use. A further feature of the present invention, as a result of the use of lever arms connected by a connector assembly, is that the book support may be moved toward or away from a user reclining in a bed without altering the angle of inclination, by simply moving one lever with respect to the other through parallel planes. Moreover, the connector assembly permits the lever arms to be locked in a desired angular relation.

Yet, another object to the present invention is to provide a book holder having a relatively simple construction, which is light in weight and easy to mount in position for use.

Still a further object of the present invention is to provide a book holder of the foregoing type having book supporting arms for maintaining the book in an open position with opposing pages spaced apart by approximately 120° thus avoiding excessive damage to a bookbinding and placing the pages in a more convenient position for use.

Yet, another object of the present invention is to provide a book holder having a lamp or illuminating means mounted on a separate bracket so as to be independently useful from the book holder.

Other features, objects and advantages of the present invention will become more apparent from the detailed description of the invention in connection with the accompanying drawings to be described more fully hereinafter.

SUMMARY OF THE INVENTION

The foregoing objects, features and advantages of the present invention are generally accomplished by providing a book holder which includes a mounting bracket for mounting the book holder on a support surface, a first lever arm pivotally connected to the mounting bracket, a second lever arm connected to the first lever arm for articulated movement with respect thereto, the first and second lever arms each having a longitudinally extending guide slot, a lockable connector assembly carried for sliding movement in the guide slot of each of the lever arms thereby connecting the first lever arm with the second lever arm, and a book support carried at an end of the second lever arm for supporting thereon the reading material.

The mounting bracket includes a plate member which permits mounting the book holder on a flat supporting surface such as a wall or a bedframe. The connector assembly for connecting the first and second lever arms includes a pair of interlocking discs each engaged with one of the lever arms, a guide pin extending through the discs and a wing nut on the guide pin for use in adjusting the lever arms and in locking the discs for securing the selected angular relationship of the lever arms. The interlocking discs have rectangularly shaped projections which engage within the slots in the lever arms for interengaging the discs and lever arms.

The book support for carrying the reading material includes a rod connected to the end of the second lever arm by a bracket and a pair of book frames carried for movement toward and away from each other on the rod. The bookframes each comprise a platform having legs extending at 120° to each other for supporting the reading material. Page retainers comprising protrusions or elongated flanges are carried on the platforms and extend in a direction perpendicular to the platforms toward the opposite bookframe for retaining the pages of a book carried between the bookframes.

A lamp for illuminating the material carried in the bookframes is also carried by the book holder. A pivotally mounted bracket supports the lamp so that it may be used independent of the book holder for illuminating other areas of the room.

BRIEF DESCRIPTION OF THE DRAWINGS

There follows a detailed description of the invention in connection with the following accompanying drawings in which.

DESCRIPTION OF THE INVENTION

Figure 1:
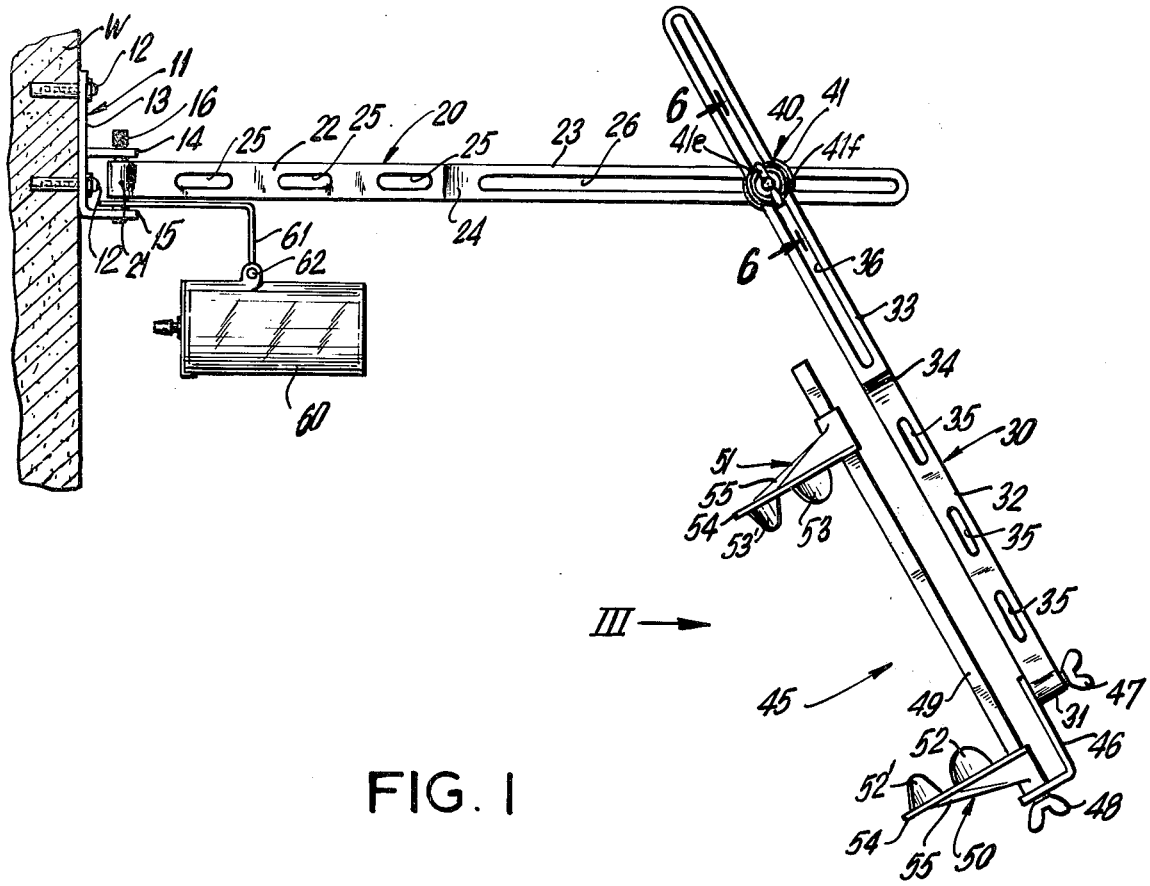
FIG. 1 is a side elevational view of the book holder according to the present invention as shown mounted on a wall.
Figure 2:
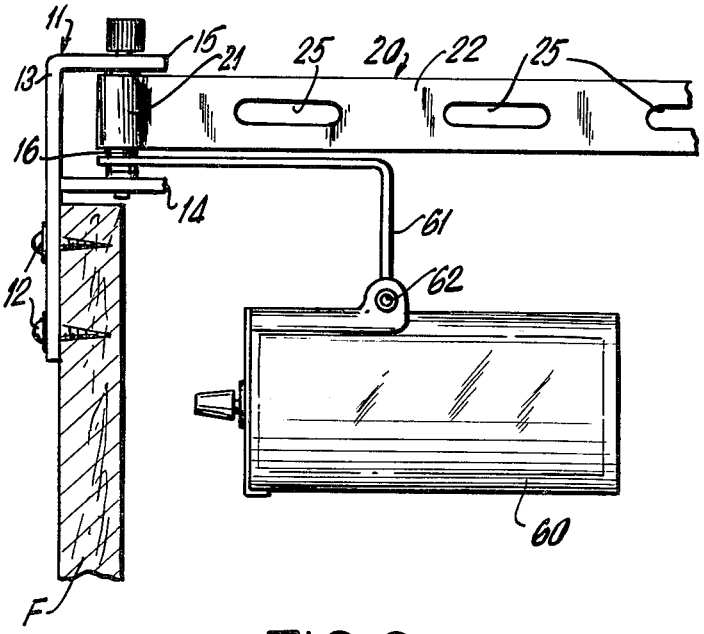
FIG. 2 is a partial side elevation view showing only the mounting portion of the book holder according to the present invention as mounted on a bedframe.

Referring now in more detail to the accompanying drawings, the book holder according to the present invention includes a mounting bracket 11 which may be secured to a wall W as shown in FIG. 1 or to a bedframe F as shown in FIG. 2. The mounting bracket 11 is provided with appropriate screw holes so that screws 12 can pass therethrough to secure the bracket either to the wall W or the bedframe F.

The mounting bracket 11 has the general shape of the letter F having a plate member 13 and two parallel extending transverse members 14 and 15. A supporting axle 16 is mounted on the friction bearings between the transverse members 14 and 15. The bracket 11 may be made of lightweight metal or plastic. The transverse members 14, 15 assure adequate guidance and support for the axle.

A first lever arm 20 is carried at one end thereof for pivotal movement about axle 16. For this purpose, lever 20 is provided with a supporting sleeve 21 through which the axle 16 will pass. The lever arm has two parts 22 and 23 with a bend transition 24 between them. The lever arm 20 can be made of lightweight metal and is provided with a series of slots 25 which further serve to lighten the structure.

Part 23 of the lever arm 20 is provided with an elongated guide slot 26 extending substantially the entire length of the part 23.

A second lever arm 30 is identical in construction with the first lever arm 20 and also has two parts 32 and 33 with a bend transition 34 joining them. Similarly, part 32 includes lightening slots 35 and part 33 has an elongated slot 36. End 31 of lever arm 30 is shaped identically with end 21 of lever arm 20 into the shape of a sleeve for holding book supporting frames to be described more fully hereinafter.

Figure 6:
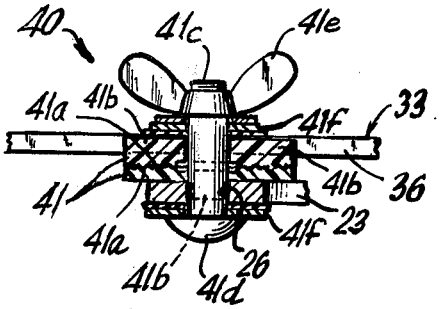
FIG. 6 is a partial cross sectional view taken along the line 6—6 in FIG. 1.

Lever arm 30 is pivotally connected with lever arm 20 through a lockable connector assembly 40. Assembly 40, note FIG. 6, comprises a pair of annular discs 41, 41 positioned between the two lever arms. The faces of the discs 41, 41 directed toward one another each have an annular ring of teeth **41*a* which interengage with the other. The opposite face of each disc has a rectangular shaped projection 41*b* which engages in the slot of the adjacent lever arm. A guide pin 41*c* extends through the slots of the lever arms 20, 30 and through the openings in the discs. A head 41*d* is located on one end of the pin 41*c* and its other end is threaded and receives a wing nut 41*e*. Washers 41*f* encircle the guide pin between the head 41*d* and one lever arm and between the wing nut 41*e*** and the other lever arm.

The discs 41 can be made of metal or a hard plastic. To lock the angular position of the lever arms 20, 30 the wing nut **41*e* is tightened against the washers so that the rings of teeth 41*a*, 41*a* on the discs 41, 41 are forced into locking interengagement. When it is desired to change the angular position of the lever arm, the wing nut is backed off on the pin until the teeth on the discs are disengaged permitting relative movement. The projections 41*b*** on the discs hold them in the slots of the lever arms. After repositioning the lever arms, the wing nut is tightened on the guide pin relocking the toothed interengagement of the discs.

As a result of this construction, lever arm 30 may be pivotally moved with respect to lever arm 20 in either a clockwise or counterclockwise direction by rotating the arm about the assembly 40. Additionally, lever arm 30 may be moved in a longitudinal direction by loosening the wing nut **41*e* and sliding the arm along the projection 41*b* on the adjacent disc without changing the distance of the bearing from the wall W. Also, the distance of lever arm 30 from wall W may be varied by moving the connector assembly 40 longitudinally along slot 26 without altering the angular position of lever arm 30 with respect to lever arm 20**.

A book support generally indicated by reference numeral 45 is carried at the end 31 of lever arm 30 in the following manner. A substantially L-shaped bracket 46 is connected to the end 31 of the lever arm 30 by bolt and wing nut 47. A rod 49 is supported at the other end of L-shaped bracket 46 by wing nut 48. The rod is rectangular in cross section and preferably squared. A pair of bookframes 50 and 51 having book page retainers 52 and 53 respectively and facing each other, are carried for longitudinal movement toward and away from each other on rod 49 so as to accommodate and support therebetween books of various sizes. The cross sectional shape of the rod prevents displacement of the page retainers.

The bookframes are preferably made of molded plastic having platforms 54 and one or more supporting ribs 55.

Figure 3:
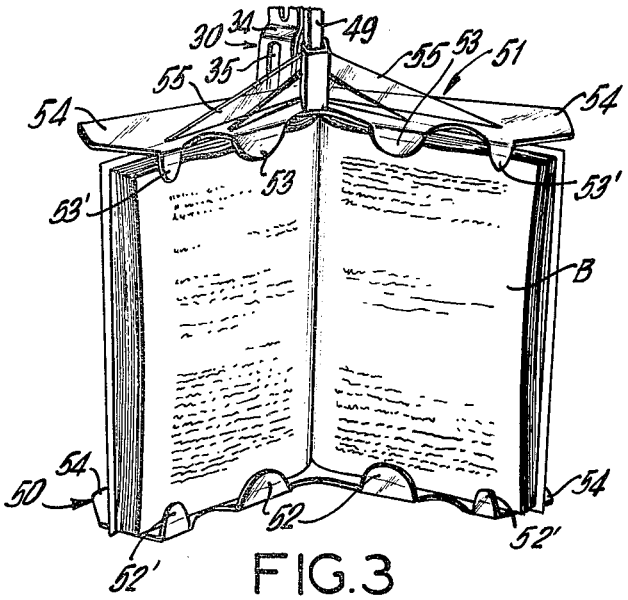
FIG. 3 is a perspective view in a direction taken along arrow III showing a book carried in the book holder and supported between book supporting frames of one type.

FIG. 3 shows one embodiment of the bookframes 50 and 51 having page retainers 52, 52' and 53, 53' formed as protrusions extending from the platform 54.

Figure 4:
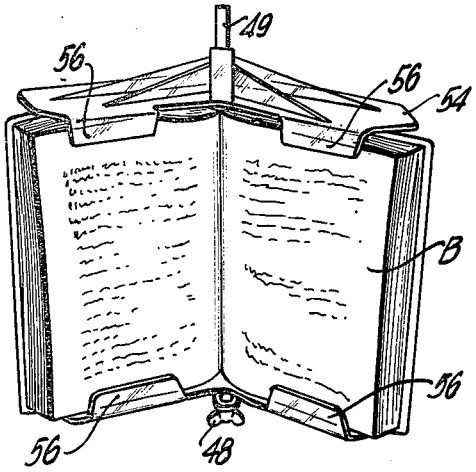
FIG. 4 is a view similar to that of FIG. 3 showing a book mounted between book supporting frames of another type.
Figure 5:
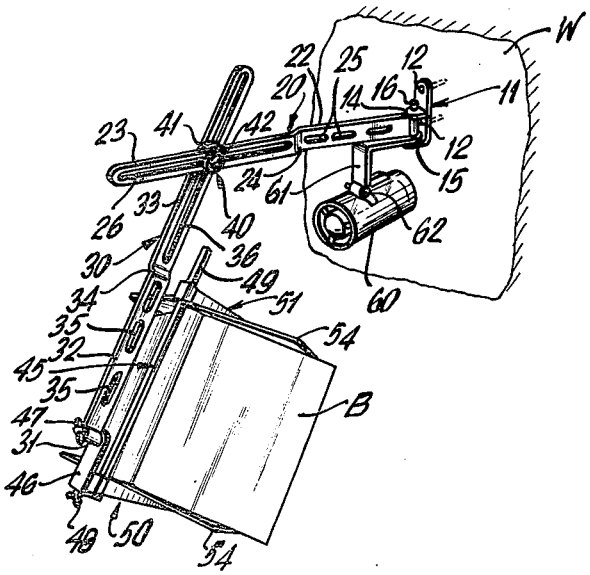
FIG. 5 is a perspective view showing the book holder in accordance with the present invention as mounted on a wall.

FIG. 4 shows a slightly modified embodiment of the bookframes 50 and 51 in which the page retainers comprise an alongated flange 56.

In both embodiments of the bookframes, the platforms 54 have two legs extending at an angle of approximately 120° to each other so that a book "B" supported between the bookframes will similarly have its pages extending at an angle of 120° to each other, corresponding to the angle of the platforms. It has been found that pages held at an angle of approximately 120° to each other tend to be easier to read since the reader's eyes may be centrally positioned and focus on all of the words of both pages at approximately the same distance from the reader's eyes. This is believed to be an advantage over holding the pages at 180° to each other which may result in some eyestrain.

A lamp 60 is carried at one end of an L-shaped bracket 61 at pivot point 62 so that the beam of illumination from the lamp 60 may be adjusted by pivoting the lamp about pivot point 62. The other end of bracket 61 is mounted for pivotal movement about axle 16 so that lamp 60 may be pivoted away from the area for illuminating a book held in the book support 45 and may be used independently of the book holder for illuminating other items in a room.

It will be appreciated from the foregoing that a book holder is provided which is light in weight, relatively simple in construction and avoids the disadvantages of the prior art by providing a means by which the two lever arms may be moved with respect to each other in any one of a number of directions to either alter the angle of inclination of the book or to move the book toward or away from the reader without varying its angle of inclination.

It has further been found that the page retainers provided for by the present invention do not interfere with any of the printed matter in the book. Additionally, they permit turning of the pages without requiring release of spring clips or other retaining elements.

What is claimed is:

1. A book holder comprising a mounting bracket for mounting the book holder on a supporting surface, a first lever arm pivotally connected to said mounting bracket, a second lever arm connected to said first lever arm for articulated movement with respect thereto, said first and second lever arms each having a longitudinally extending guide slot, a lockable connector assembly carried for sliding movement in the guide slot of each of said lever arms thereby connecting said first lever arm with said second lever arm, and a book support carried at an end of said second lever arm for supporting thereon said reading material, said connector assembly comprising a pair of annular discs, each of said discs having a first face arranged to contact the first face on the other and a second face directed in the opposite direction, said discs positioned between said first and second lever arms, first means on said first faces for interlocking said discs, second means on said second faces for interengaging said discs with the adjacent said lever arm, and third means for releasably securing said discs in locked interengagement, and said first means comprising a ring of teeth formed on said first surface of each said disc, said teeth being interengageable for effecting locked engagement of said discs.

2. The book holder according to claim 1 wherein said mounting bracket comprises a plate member, and means for securing said plate member to a flat supporting surface.

3. The book holder according to claim 1 wherein said second means comprises a rectangularly shaped projection extending outwardly from the second face of each said disc, said projection shaped to fit in closely fitting engagement within the slot in the adjacent said lever arm so that relative movement between said disc and said lever arm can be effected in the elongated direction of the slot in said lever arm.

4. The book holder according to claim 3 wherein said third means comprises a guide pin having a head at one end and being threaded at the other end, said pin arranged to fit through the slots in said first and second lever arms and through said annular discs, a wing nut in threaded engagement with the threaded end of said pin for lockably securing said discs in locked interengagment and for retaining said projections on said discs in interengagement with the slots in said lever arms.

5. The book holder according to claim 4 comprising washer means encircling said pin between said wing nut and the adjacent said lever arm and between said head and the adjacent said lever arm.

6. The book holder according to claim 5 wherein said washer means includes a resilient washer member in surface contact with each of said lever arms, and a rigid washer positioned at one end of said pin and between said resilient washer and said head and at the other end of said pin between said resilient washer and said wing nut.

7. The book holder according to claim 1 wherein said book support comprises a bracket for connection to the end of said second lever arm, a support rod connected to said bracket, said support rod having a rectangular cross section, a pair of bookframes mounted on said rod for movement toward and away from each other for supporting therebetween said reading material.

8. The book holder according to claim 7 wherein each of said bookframes comprises a platform having a surface for engaging the edges of a book and having legs extending at an angle of 120° to each other, and page retainers mounted on said platform extending in a direction toward the other bookframe.

9. The book holder according to claim 8 wherein each of said bookframes is made of molded plastic having supporting ribs on a surface facing away from the surface for engaging the edges of a book.

10. The book holder according to claim 9 wherein said page retainers comprise protrusions extending from the platform of each of said bookframes in a direction perpendicular to said platform toward the other bookframe.

11. The book holder according to claim 9 wherein said page retainers comprise an elongated flange on the edge of said platforms extending in a direction perpendicular to the surface of said platform engaging the edges of said book and directed toward the other of said platforms.

12. The book holder according to claim 1 further comprising a lamp pivotally connected to said mounting bracket for providing illumination of the reading material carried in said book support.

* * * * *